US007913934B2

(12) United States Patent
Schorn

(10) Patent No.: US 7,913,934 B2
(45) Date of Patent: Mar. 29, 2011

(54) SHOWER HEAD WITH AIR INTRODUCTION

(75) Inventor: Franz Schorn, Schiltach (DE)

(73) Assignee: Hansgrohe AG, Schiltach (DE)

( * ) Notice: Subject to any disclaimer, the term of this patent is extended or adjusted under 35 U.S.C. 154(b) by 38 days.

(21) Appl. No.: 10/538,398

(22) PCT Filed: Dec. 12, 2003

(86) PCT No.: PCT/EP03/14101

§ 371 (c)(1),
(2), (4) Date: Jun. 9, 2005

(87) PCT Pub. No.: WO2004/052550

PCT Pub. Date: Jun. 24, 2004

(65) Prior Publication Data

US 2006/0163391 A1 Jul. 27, 2006

(30) Foreign Application Priority Data

Dec. 12, 2002 (DE) ..... 102 59 255
Mar. 24, 2003 (DE) ..... 103 13 822
Mar. 24, 2003 (DE) ..... 103 13 823

(51) Int. Cl.
*F23D 11/16* (2006.01)

(52) U.S. Cl. ..... 239/419.5; 239/523; 239/589

(58) Field of Classification Search ..... 239/589, 239/590.3, 590.5, 596, 398, 419.5, 425.5, 239/428.5, 432, 434, 523
See application file for complete search history.

(56) References Cited

U.S. PATENT DOCUMENTS

| | | | | |
|---|---|---|---|---|
| 3,633,824 | A * | 1/1972 | Aghnides | 239/428.5 |
| 3,796,377 | A * | 3/1974 | O'Hare | 239/428.5 |
| 4,135,670 | A | 1/1979 | Sugimoto | |
| 4,629,124 | A | 12/1986 | Gruber | |
| 5,111,994 | A * | 5/1992 | Gonzalez | 239/428.5 |
| 5,154,355 | A | 10/1992 | Gonzalez | |
| 6,270,022 | B1 * | 8/2001 | Knapp | 239/428.5 |
| 6,869,030 | B2 | 3/2005 | Blessing et al. | |

FOREIGN PATENT DOCUMENTS

| | | |
|---|---|---|
| DE | 28 21 195 A1 | 11/1979 |
| FR | 663.556 | 8/1929 |
| JP | 52086858 A | 7/1977 |
| JP | 3286051 A | 12/1991 |
| JP | 4007051 A | 1/1992 |
| JP | 7034947 U | 6/1995 |
| JP | 9168488 A | 6/1997 |

* cited by examiner

*Primary Examiner* — Davis Hwu
(74) *Attorney, Agent, or Firm* — Duane Morris LLP

(57) ABSTRACT

A shower head with a housing and a jet outlet surface can be achieved with an example embodiment of the invention. An adjuster device is provided on one side, for adjusting the supply of water to individual or all regions, into which the jet outlet surface is divided. The above can be a central small region and the region surrounding the above. Furthermore, an air supply device is provided for aerating the water jets. The air supply device is simultaneously operated with the switching between the regions.

28 Claims, 4 Drawing Sheets

SHOWER HEAD WITH AIR INTRODUCTION

The invention relates to a shower head having a housing and a surface where jets exit the housing. The surface has numerous exit apertures. Various forms of shower heads of that type have long been known and inherently have numerous modes of operation.

The problem addressed by the invention is creating a shower head of the aforementioned type having modes of operation that are unknown under the state of the art and, in particular, have beneficial uses.

That problem is solved by a shower head having those features stated under claim 1. Beneficial embodiments of the invention are covered by the other claims, and shall be discussed in detail below. The wordings of the claims and the abstract are herewith made part of the content of this description by way of expressed reference thereto.

The shower head contains a housing whose end is closed off by a disk from which jets exit. This disk contains numerous apertures from which jets exit that may be specially configured by means of certain arrangements. In particular, the shower head contains a large, flat housing. The air intake may, for example, be configured such that it introduces air into the housing through the disk from which jets exit, for example, directly at the center of the, preferably planar, disk from which jets exit.

In order to arrive at a particularly judicious distribution of the aerated water within the housing, and thus a particularly judicious distribution of the aerated jets outside the housing, according to the invention, under an elaboration thereon, the shower head may contain means for forming several, discrete jets inside the housing. These discrete water jets will thus be formed within the housing, rather than after they exit the housing, which will allow undertaking certain procedures related to the water jets while they are still within the housing.

In elaborating on the invention, the aerator may be configured such that it aerates water upstream from the means for forming jets, in which case, the means for forming jets will serve to form, from an aerated jet, discrete, aerated jets that may then be distributed within the shower head's housing, for example, over a surface having a diameter that is larger, for example, roughly ten to twenty times larger, than that of the water inlet.

However, the means for forming jets and/or the aerator may also be, and it is preferred by the invention that it/they be, configured such that discrete jets that have previously been formed will be jointly and/or severally aerated, which will allow avoiding need for having to allow for their later aeration when forming the water jets.

In further elaborating on the invention, the shower head may have guides in order to guide the aerated water jets to the exit apertures over the full extent of the jet disk, preferably in a uniform manner, or in a nonuniform manner, if desired.

The guides may be arranged at various locations on, or within, the shower head, for example, in the distribution chamber, which is configured immediately upstream from the jet disk. However, the guides may also be arranged where the formed jets are aerated, or where the aerated jets are formed.

For example, in elaborating thereon, the guides and/or the aerator may be configured such that they generate turbulence in the aerated jets, which, if it occurs, will, among other things, represent suitable means for extending jets' dwell times within the shower head's housing in order to therewith obtain longer and/or closer contact with the devices present in the shower head's housing.

In elaborating on the invention, the aerator may be configured such that it generates an air stream that is incident on the water stream at a right angle thereto, where, as has been mentioned, the former may be incident on discrete water jets that have previously been formed.

However, the aerator may also be, and the invention covers the case where the aerator is, configured such that it generates discrete air jets or air streams, each of which will then be separately incident on the water stream.

In particular, it may be provided that every air jet is coordinated to a water jet on which it is incident. A full, or merely partial, segregation of air streams and water streams may be conducted within the housing, which will allow aerating the discrete water jets to differing degrees, or aerating them at a different location.

In order to generate the discrete water jets, the means for forming jets may, for example, have a perforated disk that is arranged at a right angle to the water stream. Every perforation will then generate a water jet. As has been mentioned, these water jets may be either totally, or merely partially, isolated from one another in order that various, discrete, narrow streams will form within a shared, common volume of water.

The aerator may have a central collar, or hub, through whose interior ambient air enters the interior of the housing. The base of the hub may, for example, have a smooth surface that, together with an associated mating surface, forms a flat, annular chamber that directs the air stream at the water. However, the base of the hub may be, and the invention covers the case where the base of the hub is, also configured such that it has radial air guides, for example, grooves, that lead to a segregation of the air stream.

The ends of the radial air guides, for example, the grooves or channels, are aligned on the apertures in the perforated disk. That alignment may, for example, be such that the centerlines of the grooves are aligned on the centers of the apertures. However, it will also be feasible to provide a tangential alignment such that the centerlines of the grooves range from off-center with respect to, to tangential to, the apertures in the perforated disk.

The air guides may be precisely radial or slightly inclined.

The hub, on whose inner end air flows essentially radially along a plane orthogonal to its longitudinal axis, may also contain guides for the aerated jets on its lateral surface, which is cylindrical. These guides might be the grooves that are aligned on the apertures in the perforated disk. These guides serve to keep the aerated jets discrete within the shower head's housing, that is, to delay, or hinder, their recombination.

The grooves may primarily follow the axial direction, but may also be slightly inclined, for example, resemble an extra-coarse thread.

A deflection by a corresponding, conical surface formed on the lateral surface of the hub may take place at the base of the hub, that is, at that location where the water stream is to be diverted radially outward, and into the interior of the shower head's housing. That deflection may also take place gradually by, for example, providing that the hub's lateral surface blends into a curved surface terminating in a radial plane. That curved surface, gradual transition, or deflection may also be present, or take place, regardless of whether axial water guides are present.

The deflectors may, if the application in mind demands, also have discrete channels that, if present, may be either straight and orthogonal to the hub's longitudinal axis, straight and inclined, or curved.

Guides that may be aligned on the deflectors' deflection axes may be arranged within the shower head's housing, that is, upstream from the jet disk, which is intended to yield an even distribution of the aerated water jets over the entire surface of the jet disk. The guides may be situated on, for example, the housing's inner wall or on an insert that is present within the housing.

In elaborating thereon, the shower head may, in addition to a housing, a surface from which jets exit that has exit apertures, and a segregation into at least two zones, have a selector. That selector is capable of switching the water intake between a first zone and a second zone. A water inlet that channels water into the shower head is also provided. An air intake is provided for the purpose of aerating water jets exiting the shower head. The air intake aerates water that enters the shower head, and does so at a location between the water inlet and the surface from which jets exit. The air intake is activatable and deactivatable, i.e., may be switched between its activated state and deactivated state. According to the invention, the selector and the air intake are intercoupled such that the air intake will be switched from the activated state to the deactivated state, or from the deactivated state to the activated state, when the selector is actuated. The air intake will thus change its activation state whenever it is switched from the first zone to the second zone. In other words, according to the invention, a dual function applies whenever the selector is actuated, which also makes it clear that the selector might operate the other way around, i.e., switch from one zone to the other whenever operation of the air intake is activated or deactivated.

That approach yields a beneficial dual function. Actuating a single control triggers two operations. In particular, operation of the air intake may be activated or deactivated by choosing to combine the zones or making its operation contingent upon combining them.

In elaborating on the invention, the first zone might be configured in the form of a section of the surface from which jets exit, where the former might, for example, be a central section thereof. In this conjunction, the second zone might be the entire surface from which jets exit. For example, operation of the air intake might be activated whenever the selector is set to the second zone or to the entire surface from which jets exit, which has the advantage that the introduction of air, or the aeration of the water jets, will allow creating streams of water exiting the shower head that appear voluminous, which, in view of the greater number of exit apertures, will be of benefit if a large area is involved.

The selector is beneficially manually actuatable. Either a knob, a slide, or similar may be depressed in order to actuate it. It will be beneficial if an entire and, in particular, large housing component, may be moved relative to another housing component or the remainder of the housing.

Both zones, or all zones, may be connected to the water inlet via a distribution chamber that supplies them with water. The distribution chamber may beneficially cover the full areas of all zones or the full area of the upstream side of the surface from which jets exit, which will guarantee a good supply of water to all zones and all exit apertures on the surface from which jets exit. The selector may be configured such that it is arranged, and acts, in the distribution chamber. When set to the first zone, it might restrict the coverage of the distribution chamber to that area corresponding to the first zone. When set to another zone, or the second zone, the restriction of the coverage of the distribution chamber might be adjusted to suit the area of the other zone involved. When set to provide coverage of the entire surface from which jets exit, the restriction of the distribution chamber's coverage might be eliminated in order that it will cover the full extent of the surface from which jets exit.

The selector may have a cap that may particularly preferentially be configured such that it will be capable of restricting the coverage of the distribution chamber. Restricting the coverage of the distribution chamber may be readily accomplished by providing that the cap may abut against the upstream side of the surface from which jets exit. That system is preferably sealed. Restriction of the distribution chamber's coverage is preferably accomplished by employing a wall as cap. The area on that wall to be involved should preferably form that part of the distribution chamber that corresponds to the selected area on the surface from which jets exit.

In order to improve the sealing of the system, a formed seal may be provided. For example, a lip seal will be suitable for that purpose. It may abut against a seat that faces upstream and merges into the restricted distribution chamber, in which case, rising water pressure will contribute to its sealing action.

One opportunity for fabricating a surface from which jets exit is choosing an elastic material, for example, an elastomer, which might be a rubbery elastomer, for that purpose. A wall or a cap might be emplaceable on the upstream side of such a jet disk in order to effect a sealing action. An aforementioned, protruding seal may beneficially be formed onto the upstream side of the jet disk, which will obviate need for employing a separate seal.

Water is beneficially inducted into the shower head centrally, in any event, in a vicinity that is situated a short distance upstream from the distribution chamber, which will allow achieving the most uniform distribution over the surface from which jets exit. A central aerator that inducts air into the shower head, or directs air onto the surface from which jets exit, will also be beneficial. Induction of water may beneficially be from the upstream side of the surface from which jets exit, or the top of the shower head. An aerator may transit a central aperture in the surface from which jets exit, i.e., protrude into the shower head's housing from that side thereof from which water exits.

A channel for inducting air that may both transit the surface from which jets exit and even be joined thereto, or attached in the vicinity thereof, may be provided. The selector may also be connected to the water inlet, or attached thereto. In the case of one embodiment of the invention, the surface from which jets exit may be moved relative to the water inlet in order to switch and activate the shower head, in which case, a shutter on the water inlet may then be employed to shut or open the channel for inducting air and, for example, a wall on the selector, would simultaneously restrict the distribution chamber's coverage.

Although, as has been mentioned, air may be inducted through that side of the shower head from which water exits, i.e., through the surface from which jets exit, it will be beneficial if air exits the aeration channel in a direction orthogonal to the water intake or water inlet. Air is inducted under exploitation of the Venturi effect, and a turbulent mixing of air in the water will occur. Air may also be distributed throughout the inducted water using that approach.

In the case of one embodiment of the invention, the water intake may have numerous apertures that may be annularly distributed about a centerline, where the apertures may beneficially be elongated slots in order to, among other things, accelerate the discrete water jets. Air from the air intake may enter immediately upstream of the apertures due to, for example, the aforementioned Venturi effect, which will allow attaining a thorough mixing of air and water.

Turbulence-generating devices situated upstream, referenced to the direction of water flow, from the location where air enters may also be provided. The mixture of water and entrained air will strike those turbulence-generating devices, which, for example, might be in the form of multistage cascades, and will become even more turbulent and admixed. Such turbulence-generating devices are beneficially distributed about a centerline of the shower head's housing, or about a channel for inducting air. For example, they might be formed on the outer walls of the channel, which will be particularly indicated if the channel for inducting air is tubular, in which case, it might be attached to the exit end of the shower head.

In addition to their turbulence-generation function, the turbulence-generating devices may be configured for providing that inducted water will be distributed over the full extent of the upstream side of the surface from which jets exit enclosed within the distribution chamber, or deflecting and distributing inducted water. It will be beneficial if an approximately uniform distribution of the inducted water entering the distribution chamber occurs.

The shower head proposed by the invention may, in particular, also find application as a side-mounting shower head. Due to the admixing with air, the water jets acquire a longer range, which, in the case of a vertically oriented surface from which jets exit, also has the benefit that the water jets will strike a standing body situated at a certain distance from the shower head over an extended area and at the desired height. Since air induction occurs through the surface from which jets exit from that side thereof from which water exits, configuring, arranging, and installing a side-mounting shower head from a coming generation of shower heads will be neither complicated nor more difficult than in the case of known side-mounting shower heads that lack air admixing.

Those and other features of the invention will be evident from the claims, this description, and the figures, where the respective individual features involved may represent themselves alone or several such in the form of subcombinations thereof implemented in an embodiment of the invention and in other areas, and beneficial and inherently patentable versions, for which patent protection is herewith claimed.

BRIEF DESCRIPTION OF THE FIGURES

A sample embodiment of the invention is depicted in the figures and will be described in detail below. The figures depict.

DETAILED DESCRIPTION OF THE SAMPLE EMBODIMENT

Figure 1:
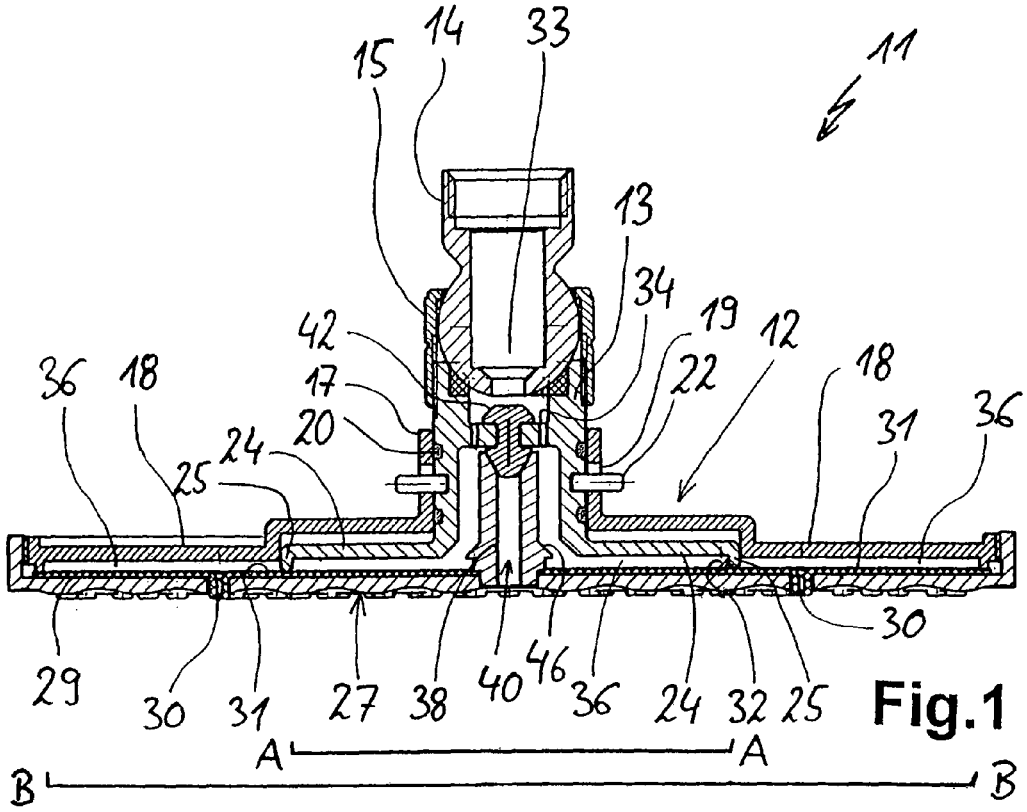
FIG. 1 a sectioned view of a shower head according to the invention having a water exit confined to a first central area and lacking air introduction, and FIG. 2 the shower head shown in FIG. 1, equipped with air introduction and switching covering the entire surface from which jets exit.
Figure 2:
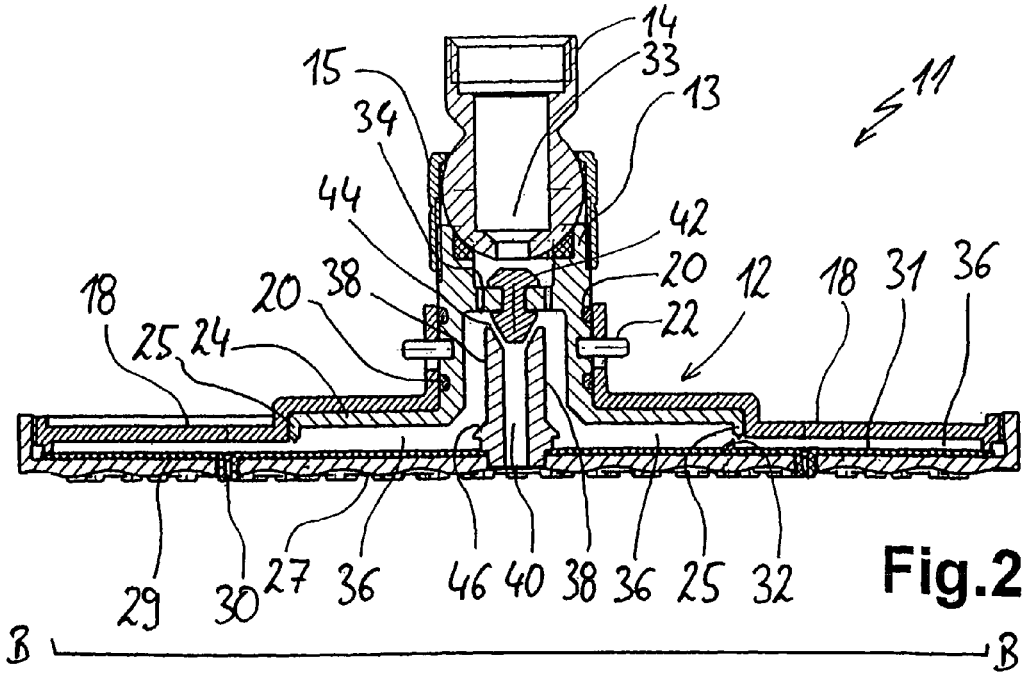

FIGS. 1 and 2 depict a shower head 11 according to the invention. The shower head 11 consists of a housing shell 12 that rests on a base 13 or is guided onto the latter. The shower head 11 is connected to a water fitting 14 having a known ball-head configuration by means of a cap nut 15. The water fitting 14 resides on, for example, a ceiling.

The housing shell 12 is essentially in the form of a tubular extension 17 that extends downward and blends into the broad extension 18. The base 13, which also broadens downward, forming an extension 24, is similarly configured.

Rubber rings 20 are inserted into the upper section of the base 13. Protrusions 22 also extend outward from the latter. The rubber rings 20 provide for a sealed joint with the tubular extension 17 of the housing shell 12. The tubular extension 17 also has inclined grooves 19 that resemble a thread. The protrusions 22 engage those grooves. The housing shell 12 thus glides relative to the base 13 when rotated, as will be clearly evident from a comparison of FIGS. 1 and 2. Pressing, and thus gliding, of the housing shell 12 relative to the base 13 directly along the centerline in order to adjust it might also employ short grooves and protrusions, instead of such an embodiment resembling a thread.

The extension 24 of the base 13 has a circumferential, annular ridge 25 extending downward from its outer rim. The latter's precise shape may be seen in FIG. 2. The annular ridge 25 merges into a narrow profile resembling a "V." In the position shown in FIG. 1, the latter provides a sealing action that will be described in greater detail below.

The shower head 11 also has a front face 27 that is joined to the housing shell 12 in the vicinity of its outer edge. The front face 27 carries the jet disk 29 on its rear face when the latter is inserted. The jet disk 29 is fabricated from an elastomer in a known manner and has molded-on nozzles for forming the exit apertures 30. From FIG. 1, and particularly from FIG. 2, it may be seen that the rear face 21 of the jet disk 29 is essentially planar. The circumferential lip 32 is the sole feature formed on the rear face 31, and may abut against the annular ridge 25, as will be evident from FIG. 1.

A water inlet 33 extends through the water fitting 14 and into the shower head 11. Water exits the ball-head on the water fitting 14 through apertures 34 that are distributed around a centerline, and enters the upper section of the distribution chamber 36, which is situated within the tubular extension 17. As is evident from FIG. 1, due to the sealing abutment of the extension 24 against the mating annular ridge 24 on the rear face 31 of the jet disk 29, water can reach only those exit apertures 30 that lie within that zone. No other water flow paths exist. In particular, the outer zone, i.e., Zone B, exclusive of Zone A, is blocked.

If the housing shell 12, together with its extension 18, is translated downward relative to the base 13, then the extension 24, together with its annular ridge 25, will jolt away from the rear face 31 of the jet disk 29. The distribution chamber 36 will be open all the way, and will then include the zone extending from the apertures 34 on the water inlet 33 to the full extent of the rear face of the jet disk 29. Water will then be able to exit through all exit apertures 30 on the jet disk 29.

Furthermore, how, in this case, the cap 42 is slid off the upper aperture in the air channel 38 will be evident from a comparison of FIG. 2 to FIG. 1. The air intake 40 will thus be open, from the front face of the jet disk 29, or the front face 27 of the shower head 11, into the shower head, or into the distribution chamber 36. As may be seen, air exiting the upper aperture on the air channel 38 is incident on the water shooting downward through the apertures 34 and into the distribution chamber 36 at roughly a right angle thereto. Due to the Venturi effect, the entering water will entrain the air. A certain admixing of water and air will have already simultaneously commenced.

That water-air mixture is incident on a turbulence-generating extension 46 that is formed on the lower section of the outer wall of the air channel 38. As may be seen from the chamfering of the turbulence-generating extension 46, water incident thereon from above will be deflected sideward, i.e., into the side-arm of the distribution chamber 36. Turbulence in, or admixing, of the water-air mixture will also occur. Further, similar extensions, or necks, might be added at this location. The turbulence-generating extension is preferably configured in the form of a multistage cascade. The envelope of the cascaded stages may match the chamfering.

As may be seen from the figures, the profile of the extension 24 of the base 13 matches the profile of the extension 18 of the housing shell 12. The step in the extension 18 provides space for the extension 24 to enter the step. It also restricts the coverage of the outer, annular-section of the distribution chamber 36 such that the water supply to all exit apertures 30 will be approximately equal in the position shown in FIG. 2, i.e., when water is supplied to the full extent of the jet disk 29.

As will be evident from FIG. 2, in addition to a more or less discontinuous switching between the first zone A and the second zone B, as well as between aerated and nonaerated, it will, under some circumstances, also be feasible to configure at least one of the functions such that it may be continuously controlled. In particular, the aerator may be employed for that purpose. The shapes of the lower section of the cap 42 and the associated aperture in the upper section of the air channel 38 might be configured such that the motion of the housing shell 12 relative to the base 13 will yield a continuous opening of the air intake 40 via the air paths 44 over its full travel, where that opening may transpire more rapidly than will be the case when the distribution chamber 36 is opened.

Figure 3:
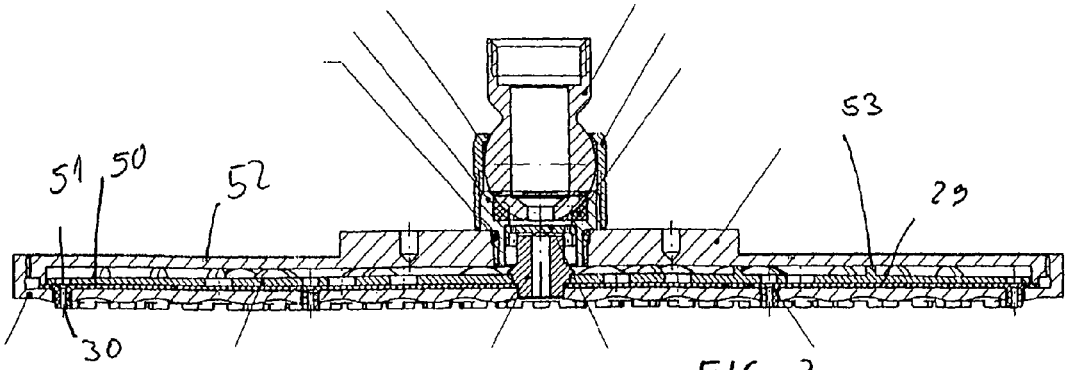
FIG. 3 A view, corresponding to that of FIG. 1, of another embodiment.

FIG. 3 depicts a shower head similar to the embodiment shown in FIGS. 1 and 2, except that it lacks a selector. An insertable plate 50 that has bores 51 corresponding to the exit apertures 30 on the jet disk 29 is arranged upstream from the jet disk 29. The insertable plate is fabricated from a harder plastic than that employed in fabricating the jet disk 29. Among other things, the former's purpose is retaining the elastomer jet disk 29 on the front face 27 thereof and on the base 52 of the housing, which is intended to prevent the inclination angles of individual nozzles from changing during installation, or during operation.

The insertable plate 50 has discrete ribs 53 on its upstream side that subdivide the space between the jet disk and the housing's rear wall 52. That subdivision is intended to guide and direct the individual, aerated jets within the housing.

Further details, in particular, details related to the supply of air and water, shall be discussed below.

Figure 4:
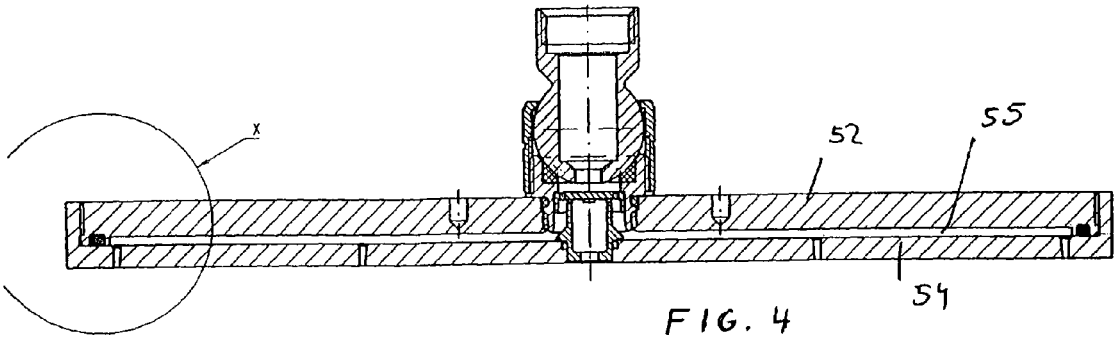
FIG. 4 a sectioned view, corresponding to that of FIG. 3, of another embodiment.
Figure 5:
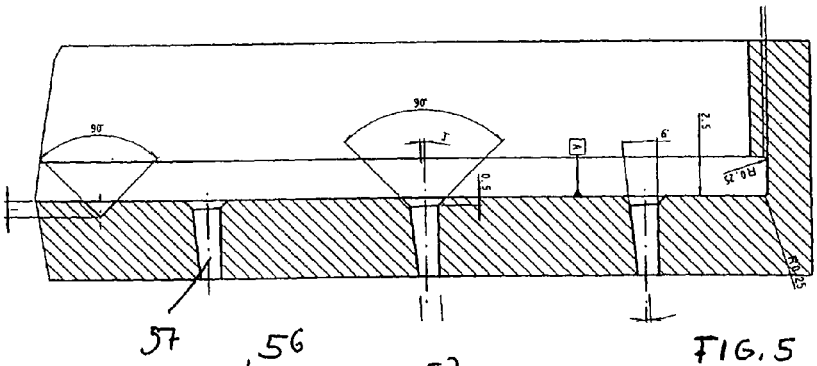
FIG. 5 a sectioned view of the jet disk of the embodiment shown in FIG. 4, drawn on an enlarged scale.
Figure 6:
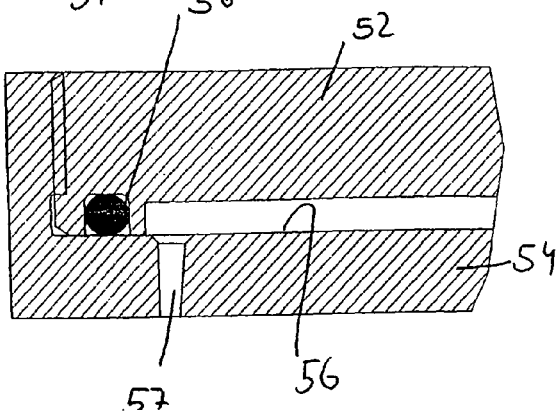
FIG. 6 a sectioned view of the edge of the housing of the embodiment shown in FIG. 4, drawn on an enlarged scale.

FIG. 4 depicts another embodiment of a shower head that, in this case, is particularly simply configured. The shower head's housing contains a rear wall 52 and a very simple jet disk 54, between which a rather flat, disk-shaped, distribution chamber 55 is formed. Sealing thereof takes place in the vicinity of its edge, and employs a seal present in a groove 56 on its rear wall 52 that abuts against the upstream side 56 of the jet disk 54 (cf. FIG. 6). In this case, the entire jet disk 54 is fabricated from a relatively hard plastic in order that the inclinations and shapes of the apertures 57, from which jets exit, will remain constant. As may be seen from FIG. 5, which depicts a view of the housing shown in FIG. 4, drawn on an enlarged scale, the apertures 57, from which jets exit, are inclined and conical.

Since the fitting connecting the housing of the shower head shown in FIGS. 3 and 4 to the water line corresponds to that shown in FIG. 1, these details need no further explanation. In the case of the embodiment shown in FIGS. 3 and 4, water entering through the inlet will now be incident on a perforated disk 60 orthogonal to the direction of water flow (cf. the enlarged-scale depiction appearing in FIG. 7). The perforated disk 60 is circular and planar, and has a circumferential ridge 61 extending downstream. The diameter of the orifice 62 in the inlet is much smaller than that of the perforated disk 60. The circular apertures 63 arranged on the perforated disk 60 are arranged around its circumference. Water thus must first be deflected outward, away from the aperture 62, if it is to reach the apertures 63.

Figure 7:
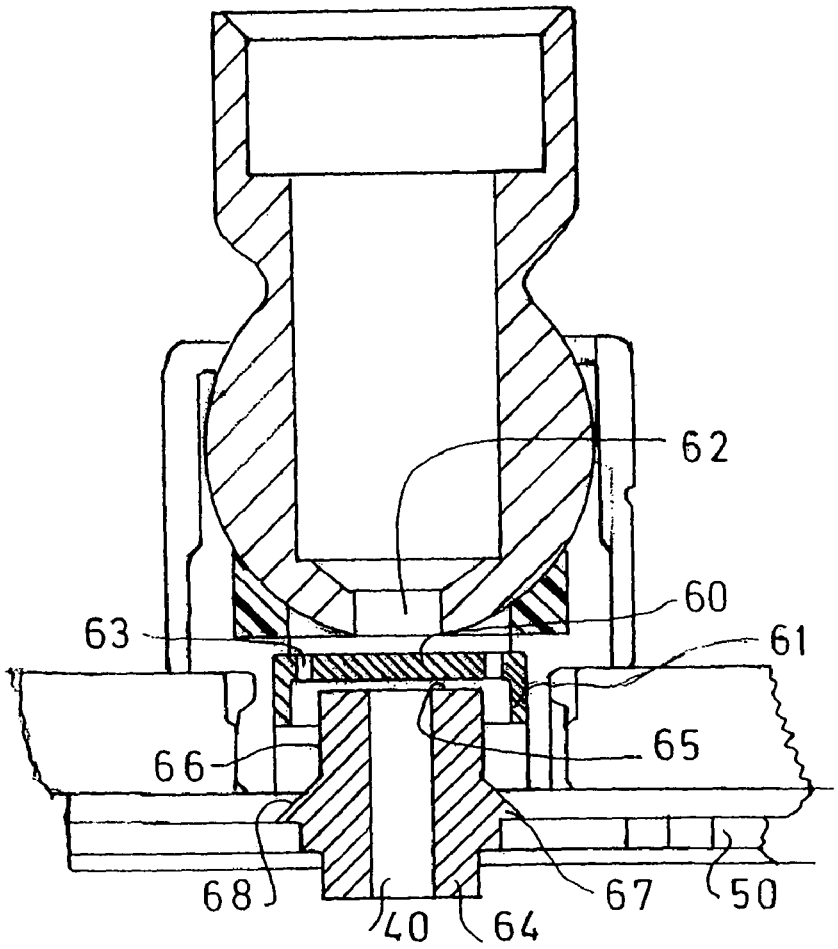
FIG. 7 a sectioned view of the central section of the embodiment shown in FIG. 4, drawn on an enlarged scale.

The apertures 63 in the perforated disk 60 segregate incoming water into discrete water jets. The aeration hub 64, which is present in both the embodiment shown in FIG. 3 and the embodiment shown in FIG. 4, is arranged immediately downstream from the central section of the perforated disk 60. FIG. 7 depicts the embodiment shown in FIG. 3, drawn on an enlarged scale. The upstream end of the aeration hub 64 is in the form of a planar terminal surface 65 situated a short distance on one or the other side of the perforated disk 60. Air inducted through the central aperture 40 in the aeration hub 64 is directed at the water jets, which have previously been segregated, in the form of a very narrow, flat stream. A Venturi effect that inducts the air stream at the intersections thereof arises due to the high flow rates of the water jets downstream from the apertures 63.

The aerated jets then travel along the cylindrical lateral surface 66 of the aeration hub 64 to the base 67 of the hub, where the lateral surface thereof expands, forming a truncated cone having a half angle of, for example, about 45°. That conical extension 67 abuts against the insertable plate 50, on which water then flows radially outward along a plane. The angle of the deflecting surface 68 might fall within the range 10°-80°. A gradually curved transition is also feasible. That deflecting device deflects the aerated water jets radially outward, and into the distribution chamber arranged upstream from the jet disk.

Figure 8:
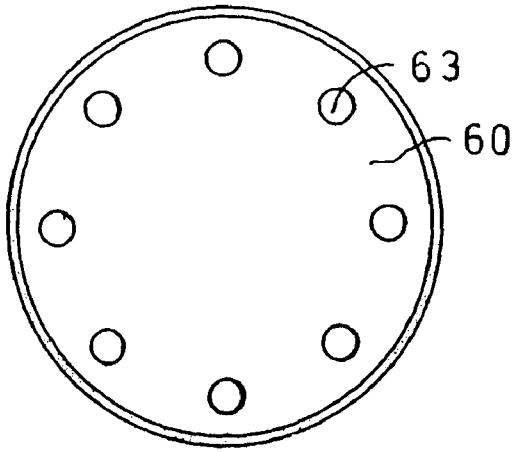
FIG. 8 a top view of the perforated disk of the embodiment shown in FIG. 7.

FIG. 8 depicts a highly schematized top view of the perforated disk 60, which has eight apertures 63. In the case of an actual embodiment, the number of apertures 63 will be greater than that in order to generate the greatest possible number of water jets. All of the apertures 63 lie on a circle near the perimeter of the perforated disk 60.

Figure 9:
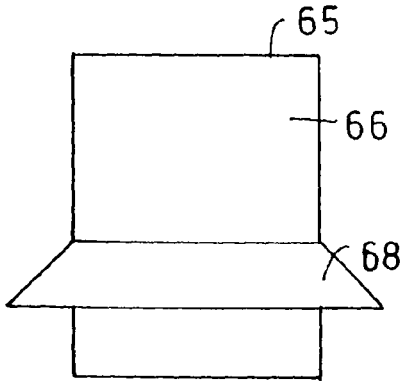
FIG. 9 a side view of the aeration hub of the embodiment shown in FIGS. 3 and 7.

FIG. 9 depicts a side view of the aeration hub 64 shown in FIG. 7. It is clearly evident that the deflecting surface 68 extends all around the perimeter thereof. In the case of the embodiment depicted there, the lateral surface 66 thereof is smooth, as is its terminal surface 65.

Figure 10:
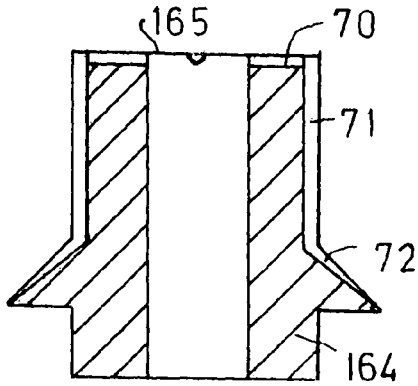
FIG. 10 an axially sectioned view of an aeration hub that has been modified relative to that shown in FIG. 9.
Figure 11:
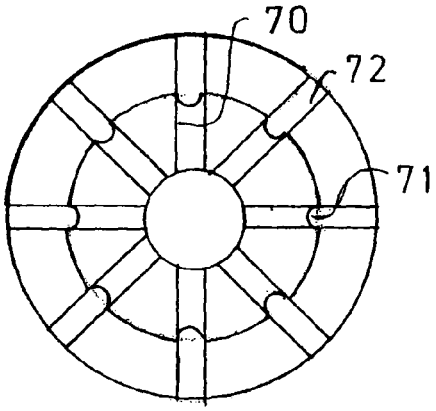
FIG. 11 a top view of the aeration hub shown in FIG. 10.
Figure 12:
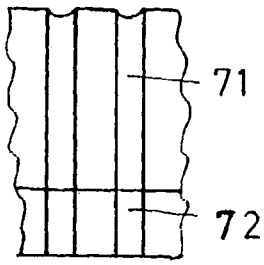
FIG. 12 a deconvolution of the side view of the aeration hub shown in FIGS. 10 and 11.

FIGS. 10-12 depict an embodiment of an aeration hub 164 that is a modification of the aeration hub 64. Several radial channels 70 that extend from the interior 40 of the hub 164 to its lateral surface are configured on its terminal surface 165. Axial channels 71 that are formed by grooves are present on its lateral surface, at the same locations as the radial channels 70. Every radial channel 70 merges into an axial channel 71. Further channels 72 that extend the other channels 70, 71, and whose depth decreases toward the bottom end of the deflecting surface 68 (cf. FIG. 10), are formed on the deflecting surface 68. This approach will provide that discrete air jets that will then be incident on the water jets formed by the apertures 63 at the locations where they are formed will originate on the terminal surface 165 of the aeration hub 164.

Figure 13:
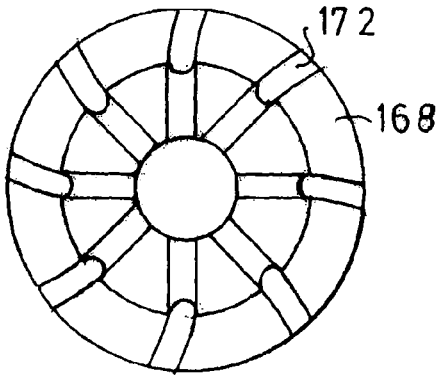
FIG. 13 a view, corresponding to that of FIG. 11, of a modified embodiment.
Figure 14:
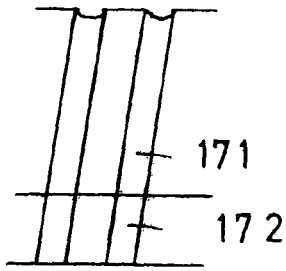
FIG. 14 a deconvolution of the side view of the embodiment shown in FIG. 13.

In the top view of FIG. 11, the channels 72 in the deflecting surface 68 are still straight and radially oriented. However, FIGS. 13 and 14 depict the corresponding views in the case of another aeration hub, where the channels 172 in the deflecting surface 168 are arched, or curved, which will give the aerated jets an inclination that they will retain upon exiting the aeration hub. That approach will generate turbulence in the aerated jets within the distribution chamber of the shower head's housing.

In the case of the embodiment shown in FIG. 14, which depicts a deconvolution of a side view of an aerating hub, the channels 171 are inclined with respect to its longitudinal axis and resemble an extra-coarse thread, rather than straight and parallel to its longitudinal axis, as in the case of the embodiment shown in FIG. 12, which will initiate generation of vortices in the aerated jets earlier.

The aeration jet 164 shown in FIG. 10 may, for example, be arranged such that the lands between the channels 70 that lie in the plane of its terminal surface 165 will contact the underside of the perforated disk 60, which will then result in totally isolated air jets being generated. However, a certain spacing might also remain in order that a preferred flow field may be generated at the locations of the channels 70.

What has been said about the guides, based on the aeration hubs, may also be carried forward into the distribution chamber. For example, the apertures from which jets exit might be arranged in the form of straight extensions of projections of the channels 72, 172. However, not all channels 72/172 will need to have the same curvature or the same direction. It may be provided that aerated water jets that are to be deflected further outward, into the distribution chamber, exit the base of the aeration hub along straight paths, while those to be deflected to apertures from which jets exit that are closer in are given more turbulence.

Due to the simplified representations employed, the embodiments shown in FIGS. 3-14 exhibit no switching device for switching between various zones of the surface from which jets exit. They also exhibit no device for switching the aerator on and off. Nevertheless, the measures for generating and maintaining discrete, aerated jets involved are, of course, also possible, and sensible, in the case of shower heads that have such switching devices. The invention expressly proposes precisely that.

The invention claimed is:

1. A shower head having a housing and a water inlet for admitting water to the housing, a jet disk for exit of jets, wherein the jet disk has a front face having numerous apertures from which the jets exit from the shower head, an aerator for aerating water flowing through the shower head, wherein the aerator is configured such that the aerator generates discrete aeration jets, wherein the aerator comprises a hub located centrally in the jet disk, the hub having an axial passage through which air intake takes place from the front face of the jet disk, at least one radial air conduit being provided in a vicinity of an end of the hub that is located upstream of the jet disk and faces an interior of the housing, and aerated water flowing along a lateral outside surface on an exterior of the hub, and, wherein said exterior of the hub has essentially axially arrayed guides and a deflector arranged on a base of the hub, a surface of the deflector expanding along a water flow direction, the deflector forming a truncated cone guiding the discrete aerated jets outwardly from the hub toward the apertures from which the jets exit the jet disk.

2. A shower head according to claim 1 having a structure for forming several said water jets.

3. A shower head according to claim 2, having guides for guiding aerated water jets to the apertures from which jets exit, over the entire jet disk.

4. A shower head according to claim 3, wherein at least one of the guides and the aerator is configured to generate turbulence in the aerated jets.

5. A shower head according to claim 3, further comprising guides on at least one of a rear face of the jet disk and a front face of a rear wall of a distribution chamber of the housing of the shower head.

6. A shower head according to claim 2, wherein the structure for forming jets comprises a perforated disk.

7. A shower head according to claim 1, wherein at least one of a means for forming jets and the aerator is configured such that individual water jets are aerated at least one of jointly and severally.

8. A shower head according to claim 1, wherein the discrete aerated jets are each coordinated to a water jet.

9. A shower head according to claim 1, wherein the guides comprise channels on the exterior of the hub of the aerator and the channels are inclined.

10. A shower head according to claim 1, wherein the aerator is selectively activatable and deactivatable.

11. A shower head according to claim 1, wherein a surface from which the jets exit has at least two zones and further comprising a selector for switching between conducting water to the first zone and conducting water to the second zone, wherein the selector and one or both of the aerator and an air intake, are intercoupled such that the air intake is switchable for changing between an activated state and a deactivated state or to change activation states, when the selector is actuated.

12. A shower head according to claim 11, wherein the first zone is part of the surface from which the jets exit and the second zone covers the entire surface from which the jets exit, including the first zone, and wherein the first zone is centrally arranged on the surface from which the jets exit.

13. A shower head according to claim 11, wherein operation of the air intake is activated whenever the selector is set to the second zone.

14. A shower head according to claim 11, wherein the selector is manually actuatable, by moving a component of the housing bearing the surface from which the jets exit, relative to a component bearing the water inlet.

15. A shower head according to claim 11, wherein the zones are connected to one of a water intake and water inlet, via a distribution chamber, where the selector restricts the distribution chamber's coverage to the first zone when set to the first zone, and that restriction of the coverage of the distribution chamber is eliminated when the selector is set to the second zone.

16. A shower head according to claim 11, wherein the selector has a cap that may be emplaced on a rear face of the surface from which the jets exit and is arranged for switching, and restricting the coverage of, the distribution chamber, wherein a structure is arranged for sealing against a rear face of a wall on the selector.

17. A shower head according to claim 16, wherein a seal abutting against a seat facing upstream, referenced to a direction of water flow, is provided for sealing.

18. A shower head according to claim 11, wherein the surface from which jets exit is formed from a jet disk fabricated from an elastic material and forms a seal on its rear face.

19. A shower head according to claim 11, wherein a water intake on the shower head is centered thereon, as is an air intake, and the air intake passes through a central aperture in the surface from which jets exit.

20. A shower head according to claim 19 having an air intake that is connected to the surface from which jets exit via a channel, where the selector is connected to the water inlet, the surface from which jets exit is movable with respect to the water inlet for selection and activation purposes, and thereby causes a shutter on the water inlet to open or shut the channel.

21. A shower head according to claim 20, wherein air from the channel enters normal to longitudinal axes of the water intake and water inlet.

22. A shower head according to claim 19, wherein the channel of the air intake is tubular, attached to the front face of the shower head, and transits a center of the distribution chamber and further comprising turbulence-generating devices formed on the channel's outer walls.

23. A shower head according to claim 11, wherein the water intake has numerous annular apertures distributed about a centerline and air from the air intake enters immediately downstream from said apertures.

24. A shower head according to claim 11 further comprising turbulence-generating devices downstream from the air inlet.

25. A shower head according to claim 24, wherein the turbulence-generating devices are configured for deflecting and distributing incoming water to zones on the surface from which jets exit.

26. A shower head according to claim 1, wherein the shower head is configured for side-mounting.

27. A shower head according to claim 1, wherein the guides comprise channels on the exterior of the hub of the aerator and the channels are angularly offset from a radial direction.

28. A shower head according to claim 1, wherein the guides comprise channels on the exterior of the hub of the aerator and the channels are curved in a plane of the jet disk.

* * * * *